US011772373B2

(12) United States Patent
Duda et al.

(10) Patent No.: US 11,772,373 B2
(45) Date of Patent: Oct. 3, 2023

(54) DIRECT TO MESH SCREEN STENCIL CREATION

(71) Applicant: DuralChrome AG, Niederrohrdorf (CH)

(72) Inventors: Martin Duda, Regensburg (DE); John Cecil Harwell, Pinea de Mar (ES)

(73) Assignee: DuralChrome AG, Niederrohrdorf (CH)

( * ) Notice: Subject to any disclaimer, the term of this patent is extended or adjusted under 35 U.S.C. 154(b) by 772 days.

(21) Appl. No.: 16/473,405

(22) PCT Filed: Jan. 5, 2017

(86) PCT No.: PCT/EP2017/050214
§ 371 (c)(1),
(2) Date: Jun. 25, 2019

(87) PCT Pub. No.: WO2018/127288
PCT Pub. Date: Jul. 12, 2018

(65) Prior Publication Data

US 2020/0147952 A1 May 14, 2020

(51) Int. Cl.
*B41C 1/14* (2006.01)
*B41J 3/407* (2006.01)

(52) U.S. Cl.
CPC ..... *B41C 1/147* (2013.01); *B41J 3/407* (2013.01)

(58) Field of Classification Search
CPC .. B41C 1/147; B41C 1/14; B41J 3/407; B41J 15/0813; B41J 15/16; B41J 15/18; B41J 15/34; B41J 15/36; B41J 15/405
See application file for complete search history.

(56) References Cited

U.S. PATENT DOCUMENTS 5,017,394 A * 5/1991 Macpherson ..... A23G 3/20 426/103
5,819,653 A * 10/1998 McCue ..... B41C 1/147 101/128.21
2009/0173245 A1* 7/2009 Irisawa ..... H05K 3/1225 427/272
2011/0297021 A1* 12/2011 van Heijningen ..... B41F 15/34 101/127
2013/0324326 A1* 12/2013 Kennedy, III ..... A63B 37/0022 473/378
2018/0029352 A1* 2/2018 Ohnishi ..... B41F 15/0818

* cited by examiner

*Primary Examiner* — Yaovi M Ameh
*Assistant Examiner* — Quang X Nguyen
(74) *Attorney, Agent, or Firm* — Olympic Patent Works PLLC

(57) ABSTRACT

The preparation of a screen stencil is provided, using a direct to mesh screen stencil printer. The DtM screen printer includes a frame for holding a pre-stretched mesh in place during application of a jettable emulsion, a fixture to hold the frame, a platen to hold a release paper against one side of the pre-stretched mesh, and a printer carriage supporting a print head for printing the jettable emulsion on a side of the pre-stretched mesh opposite the platen. The release paper is configured to inhibit dot-gain while not adhering to the jettable emulsion following its curing. A method is also provided, the method being for using the DtM screen printer to prepare the screen stencil for screen printing.

13 Claims, 3 Drawing Sheets

DIRECT TO MESH SCREEN STENCIL CREATION

CROSS-REFERENCE TO RELATED APPLICATION

This application claims priority to PCT Application No. PCT/EP2017/050214, filed Jan. 5, 2017.

BACKGROUND

Screen printing is a printing technique whereby a mesh is used to transfer ink onto a substrate, except in areas made impermeable to the ink by a screen printing stencil, also called a blocking stencil. A blade or squeegee is moved across the screen to fill the open mesh apertures with ink, and a reverse stroke then causes the screen to touch the substrate momentarily along a line of contact. This causes the ink to wet the substrate and be pulled out of the mesh apertures as the screen springs back after the blade has passed.

Creation of a screen printing stencil is a tedious, labor-intensive job. It is one that requires a number of process steps, chemical products, lots of water, and is largely manual. It is the least automated part of the current screen printing business.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
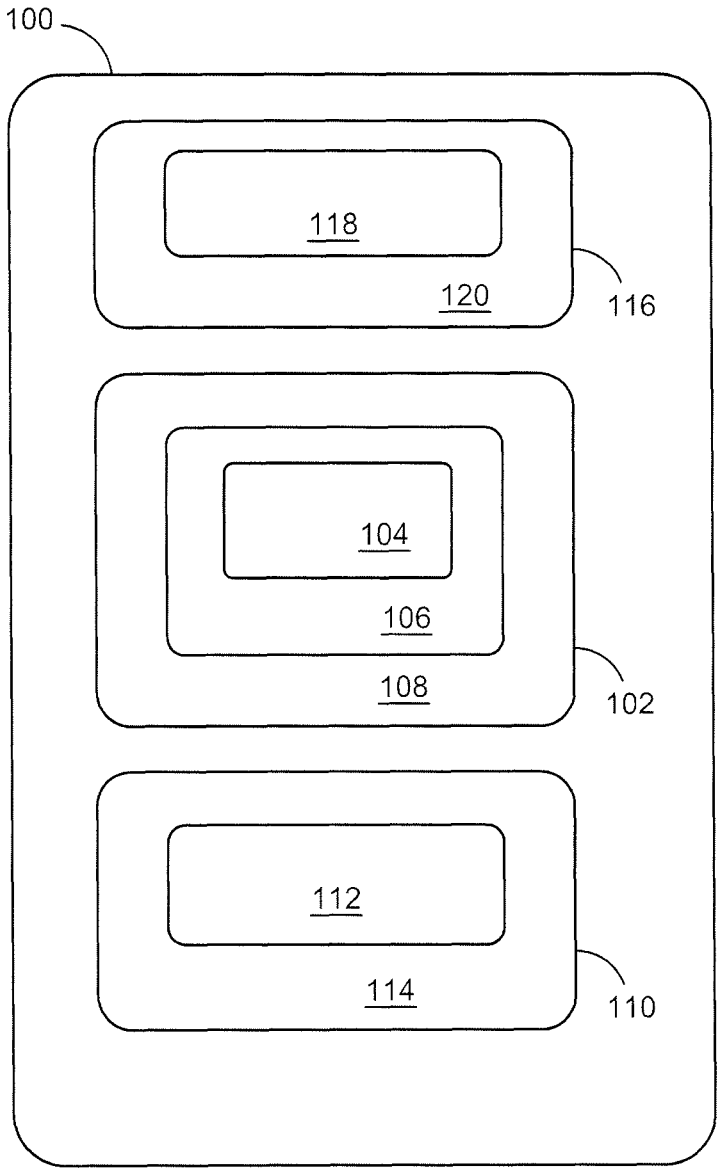
FIG. 1 illustrates a direct to mesh screen printer, according to an example of the present disclosure.

There are several examples of previous solutions for directly coating a mesh to form a stencil for screen printing. These are now described.

Mesh Preparation and Coating:

Direct application of emulsion: this is done either with a machine or by hand. Both sides of the screen must be coated with the emulsion to ensure proper coverage. The machine or automated version is strictly a machine replacing a human. The machine is much more accurate at applying precise amounts of the emulsion and getting even coverage. The machine generally has less waste.

Capillary films: These are films that are pre-coated with an emulsion. The mesh is oversaturated with water and the film (emulsion side down) is placed against the supersaturated mesh. The capillary action draws the emulsion into the mesh. This gives a more precise coating of the emulsion, both in thickness and in cover. Once the emulsion has diffused into the mesh, the film is peeled off.

Once the screen mesh is emulsified it must be dried. Once dry, it is ready for the image transfer or making of the stencil. As the emulsion dries, it contracts and conforms to the mesh causing a rough, uneven surface. (This rough surface causes an accelerated aging of the squeegee during the printing process.)

Most emulsions today are activated by ultra-violet (UV) radiation (i.e., UV-activated) but may also be visible-light activated. Once coated, the stencils must be protected from any exposure to light (even normal visible light has enough UV to start the curing process). Hereinafter, it is assumed that the emulsion is UV-activated/cured.

Image Transfer/Stencil Making:

In screen printing, there is one stencil for every color, typically cyan, magenta, yellow, and black (CMYK) plus one for every spot color (a spot color is one based on discrete colors, usually that might not be readily achievable with CYMK colors). The areas of the stencil where one does not want the inks to go through are blocked by an emulsion that is subsequently cured to form the stencil; all other areas have only mesh. Any opening in the mesh may either be completely blocked or partially blocked by the emulsion to form the stencil.

Film Positive Ink: A totally black, UV absorbent layer is printed onto a clear sheet of plastic. The printing is done normally by laser or inkjet printers with special film positive inks (film positive ink means a high opacity black ink that completely blocks all visible and UV light). The film is then attached to the pre-coated mesh and exposed to UV light. The attachment is usually by a removable tape (such as masking tape). Once exposed, the film is removed and the uncured emulsion is washed off.

However, this approach is very labor intensive at all stages, and it is not possible to automate many steps. In addition, it is prone to error, such as during mounting the film, using the correct film, adjusting the final stencil before print. Lots of chemicals and washing, as well as lots of consumables (inks, films), are required.

Thermal Screen: In this method, the mesh is pre-coated with a thermally-activated emulsion. Typically, the mesh (without a frame) is put into a thermal printer, where the emulsion is directly cured/activated. Once completed, the un-exposed emulsion is washed off, the stencil is mounted on a frame, and printed.

However, this approach suffers from limited mesh counts. Also, the emulsions are not as robust. The pre-treated mesh is expensive. The stencil alignment is more intensive. Finally, the stencil can be damaged while it is being mounted.

Computer to Screen (CtS)—Printed: In this method, the coated mesh is directly printed onto the emulsified screen with a high-opacity black ink. This is similar to Film Positive Inks without the film. All of the processes are the same.

However, these machines require a high-opacity ink, which is more expensive than regular inkjet inks.

CtS—Wax: This method is a close relative of CtS—Printed, but uses wax to block the UV light. All else is the same.

However, due to the use of melted wax, these machines can be temperamental. Further, they require that the wax be heated to apply it to the mesh.

CtS—Direct Exposure: This technology directly exposes the emulsion using a UV laser.

However, the machines used in this technology are typically very expensive. Further, the process does not work as well on coarse grade mesh. Finally, UV lasers are still very expensive when they need replacing.

Each of the above methods require some post-processing/follow-up. Except for Thermal Activated and CtS Direct Exposure, all stencils must be exposed after the image blocking is applied (either films or CtS Printed and Wax). This process takes about 1 to 2 minutes per screen with an intense developer.

All screens must have the excess emulsion washed off. Care must be taken so that the emulsion does not get into the drainage system. Screens must be dried after washing.

For the Film and Thermal Activated methods, the finished stencil must be fine adjusted when placed on the carousel to ensure proper registration.

Current Disclosure:

It is clear from the foregoing description of the current technology that a simpler approach that uses fewer chemicals and less water would be desirable.

As disclosed and claimed herein and in accordance with the teachings herein, a Direct to Mesh (DtM) approach to forming a stencil involves directly applying and activating/exposing an emulsion onto a screen using inkjet technology. In particular, and in accordance with the teachings herein, a DtM screen printer includes:

- a frame for holding a pre-stretched mesh in place during application of a jettable emulsion;
- a fixture to hold the frame;
- a platen to hold a release paper against one side of the pre-stretched mesh, the release paper configured to inhibit dot-gain while not adhering to the jettable emulsion following its curing; and
- a printer carriage supporting a print head for printing the jettable emulsion on a side of the pre-stretched mesh opposite the platen.

FIG. 1 depicts a block diagram of the direct to mesh (DtM) printer 100. The DtM printer 100 includes a mesh support system 102 that includes the pre-stretched mesh 104 held in place by the frame 106. The frame 106 is in turn held by the fixture 108. The fixture 108 securely and firmly holds the frame 106 with the pre-stretched mesh 104 in place during the application of the jettable emulsion.

As used herein, the mesh 104 is made of connected strands of textiles, fiber, metal, or other flexible/ductile materials, here, woven in a crisscross pattern. The material comprising the mesh may be any of a number of textiles (silks, polyesters); metals, such as stainless steel; or plastic, such as polypropylene, polyethylene, nylon, polyvinyl chloride (PVC) or polytetrafluoroethylene (PTFE); or fiberglass. The diameter of the strands may be any diameter common in screen printing, and the mesh size may also be any size common in screen printing. Coarser mesh is typically woven with larger diameter (gauge) strands, which requires a thicker application of the emulsion.

The DtM printer 100 further includes a paper and platen support system 110, including a release paper 112 held against one side of the pre-stretched mesh 104 by a platen 114. The platen 114 holds the release paper 112 firmly against the bottom of the pre-stretched mesh 104. The platen 114 is configured to be as smooth as possible and resistant to dents and cracks. The release paper 112 is lightly attached to the platen 114 to prevent movement during the application of the jettable emulsion. Further, the release paper 112 is coated with a coating to inhibit dot-gain while not adhering to the cured emulsion. Dot-gain need only be inhibited for a short period as the curing occurs very quickly after the fluid is jetted.

Finally, the DtM printer 100 includes an inkjet printer 116 that includes a print head 118 mounted on a printer carriage 120. The print head 118 is configured to print the jettable emulsion on the side of the pre-stretched mesh 104 opposite to that of the platen 114. The printer carriage 120 is a high-precision printer carriage, accurate in both the X and Y Cartesian directions to support accurate droplet placement over one or more passes while building up the jettable emulsion. Indeed, the emulsion can be "built up" to accommodate a wide range of mesh gauges, from very fine to super coarse. The layering can be used to maintain high resolution as it builds up the emulsion.

The print head 118 may be an inkjet print head, such as thermal inkjet, piezoelectric inkjet, drop-on-demand inkjet, or other suitable jetting printhead capable of jetting fluids, including the jettable emulsion disclosed herein.

The screen mesh 104, which may be of any type, even quite expensive or cheap and any gauge, is stretched onto the frame 106. The frame 106 is put into the printer 116 with the paper backing, or release paper, 112 which has been placed on the platen 114. The jettable emulsion is then applied by the inkjet printer 116 to the masking areas and substantially simultaneously exposed with high intensity UV lamps or other suitable UV source, such as UV-light emitting diodes (LEDs). The UV lamp (or LED) may be tuned to the reaction range of the jettable emulsion for optimal performance. For the jettable emulsion disclosed herein, the emulsion reacts at a wavelength of 395 nanometers (nm). Other jettable emulsions may have other reaction wavelengths, including lower than 395 nm. For coarse mesh, the application may be a multi-pass operation in order to build up the necessary emulsion thickness. By "coarse mesh" is meant mesh having a loose weave, and thus having larger gaps between the strands than a fine mesh screen. For example, 335 mesh count is considered to be fine mesh, while 110 mesh count is considered to be coarse mesh, where mesh count is the number of thread crossings per square inch.

The Direct to Mesh process disclosed herein is made possible with the recent development of low viscosity jettable emulsions. By "low viscosity" is meant a range from about 4 centipoises (cP) to about 15 cP. These new jettable emulsions are used to create an embossing effect with UV printers onto a wide variety of materials. These new jettable emulsions are also more elastic, so they can be used more readily as a replacement for previous emulsions. Any color can be used for the jettable emulsion, including transparent or clear, although light cyan or light magenta may be used to provide a slight contrast in order to verify the stencil.

An example of a jettable emulsion that may be suitably employed in the process disclosed herein is a UV-activated acrylate monomer with elastomeric qualities after curing. The jettable emulsions are specialty embossing "varnish" polymers that quickly cure into both highly durable/resistant layers that quickly build up on the substrate. The cured polymer is also durable and flexible/elastic (if it were rigid, it would crack easily under use and render the stencil useless). VersaUV (Roland DG) technology is an example of a material that may be useful in the practice of the teachings herein.

The paper backing, or release paper, 112 is important to prevent unexposed emulsion from just dropping through the mesh 104. It also serves to limit dot gain of the printed emulsion. Dot gain occurs when a jetted droplet (or dot) expands or spreads out before the UV exposure. This is particularly important when a half tone is employed, i.e., less than the entire space in the mesh is filled with emulsion. However, the dot-gain need only be inhibited for a short period as the UV curing occurs very quickly after the emulsion is jetted.

The paper for the release paper 112 is a special paper that manages the dot gain and also peels off easily and does not lift the emulsion. The paper is coated with one or more special chemicals that do not adhere to the cured emulsion; these special chemicals are similar in nature to transfer papers used in dye sublimation.

The release paper 112 is positioned on the squeegee side of the mesh 104. In most preparations in the current art, the emulsion can be quite rough; this is often caused by conformance of the emulsion to the mesh during the drying process. This rough emulsion surface can wear away at the squeegee, requiring resurfacing or replacing of the squeegee blade. In the Direct to Mesh process, however, when the jettable emulsion is built up in the mesh, the release paper 112 ensures a very smooth surface; see, for example, FIG. 3B and its associated discussion.

Since the only emulsion that is applied to the mesh 104 is in a blocking area, there is no over-shoot or over-exposure from reflection of the UV light into masked areas. This provides a much smoother, cleaner image. (These over-shoot and over-exposure areas can create spots or drops inside the image, especially around the edges. These are the "inverse" of pin holes.)

The platen 114 both holds the paper backing, or release paper, 112 in place and gently pushes the mesh 104 taut to ensure a good even, flat surface upon which to apply the emulsion.

Example steps of the Direct to Mesh process are depicted in FIGS. 2A-2D, which are cross-sectional views of the DtM apparatus.

Figure 2A:
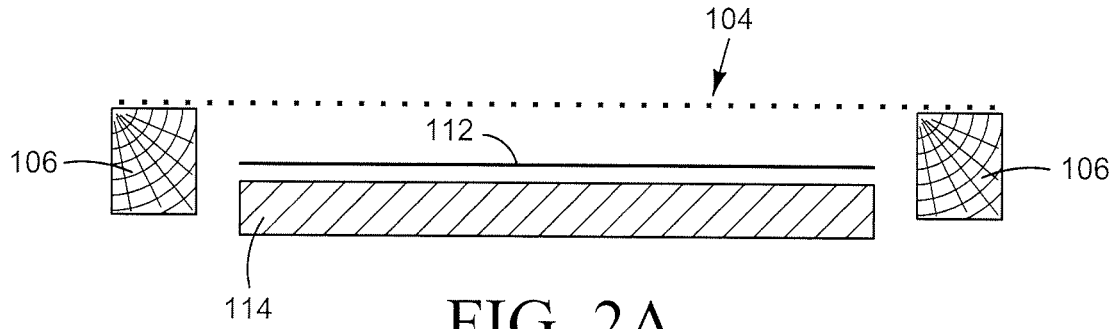
FIGS. 2A-2D depict, in cross-sectional view, elements of a process in screen printing, using a direct to mesh screen printer, according to an example of the present disclosure.

In FIG. 2A, a frame 106 supports a mesh 104. The fixture 108 for supporting the frame 106 is omitted for clarity. The frame fixture 108 is similar to what is currently used in the art. Below the mesh 104 is the platen 114 with a sheet of release paper 112 supported on surface 114*a* of the platen. The release paper 112 backs up the mesh 104 to provide good coverage of the jettable emulsion, as it is applied. The release paper 112 is formulated to avoid sticking to the jettable emulsion.

Figure 2B:
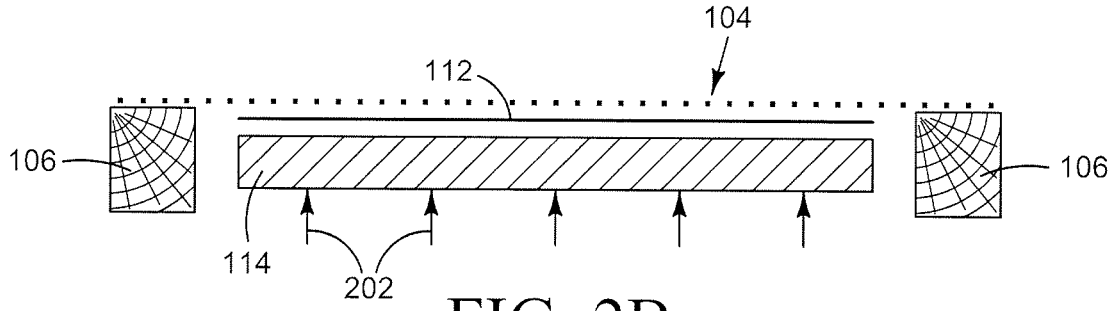

In FIG. 2B, the platen 114 with the transfer paper 112 is moved up to the mesh 104, tightening the mesh and pressing the transfer paper against the back of the mesh. This provides a smooth, tensioned, level surface to print on. The movement of the platen 114 is indicated by arrows 202.

Figure 2C:
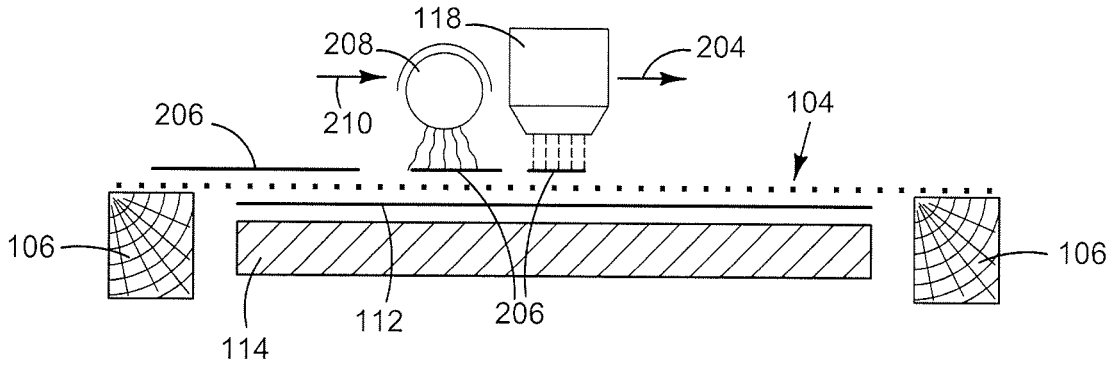

In FIG. 2C, the print head 118, which is translatable by the printer carriage 120 (not shown in FIG. 2C, but shown in FIG. 1) prints the blocking image, or stencil, 206 (seen in FIG. 2D) directly onto the mesh 104, where the blocking image is the reverse, or negative, of the actual image that is to be printed. The print head 118 moves laterally in the direction indicated by arrow 204 to form a screen stencil 206 on the mesh 104. The "ink" is the UV cured jettable emulsion, described above, which is UV-cured essentially as it is applied by means of UV source 208. In an example, the UV source moves laterally in the direction indicated by arrow 210. This is similar to what happens in a conventional UV printer. FIG. 2C depicts the print head 118 and UV source 208 moving across the mesh 104. However, the mesh support system, including the mesh 104 and frame 106 (and fixture 108), could be translated relative to the print head 118 and UV source 208.

Figure 2D:
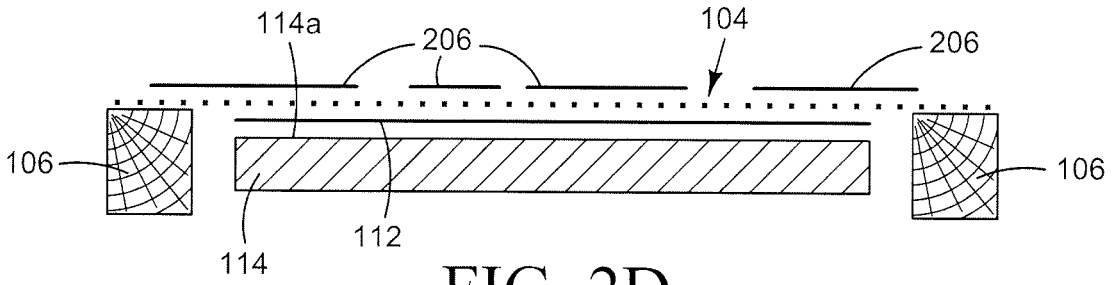

In FIG. 2D, the stencil 206 can be removed from the printer and used immediately without any other preparation or treatment.

Figure 3A:
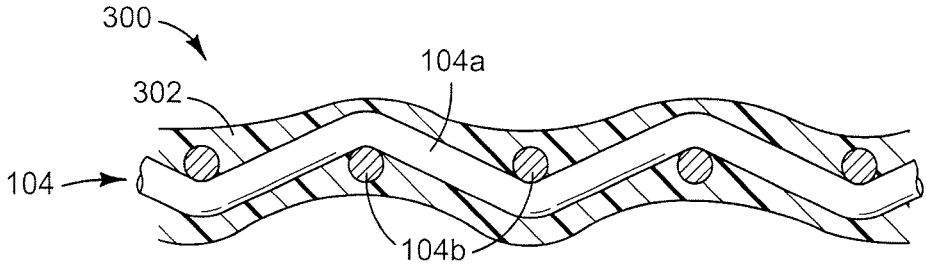
FIGS. 3A-3B schematically illustrate an emulsion on a mesh, providing a comparison between current technology (FIG. 3A) and the teachings herein (FIG. 3B), according to an example of the present disclosure.
Figure 3B:
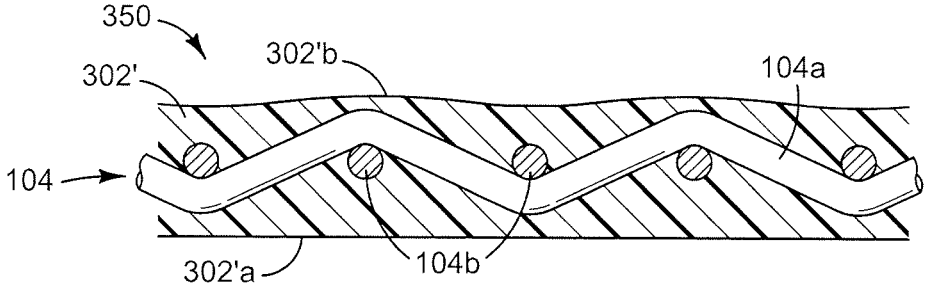

A comparison of results is shown in FIGS. 3A-3B, according to an example. Both Figures illustrate an emulsion applied to the mesh 104.

In FIG. 3A, in the combination 300 of a conventional spreadable emulsion 302 and mesh 104, the emulsion is seen to conformally follow the warp and weft (strands 104*a* and 104*b*) of the mesh, including both the top of the mesh and the bottom of the mesh. This conformality occurs as the spreadable emulsion 302 air-dries onto the mesh 104. In particular, FIG. 3A shows how the emulsion 302 applied in the conventional way shrinks as it dries onto the mesh 104 after being applied either by hand or with an applicator machine. This shrinkage is unavoidable as the water component dries. The emulsion 302 is one commonly used in the art.

In FIG. 3B, in the combination 350 of the jettable emulsion 302' of the present teachings and mesh 104, the jettable emulsion is seen to have a flat bottom surface 302'*a*, which is provided by the smooth surface 114*a* of the platen 114 (and the release paper 112 thereon). The top surface 302'*b* of the jettable emulsion 302' is seen to be less conformal to the warp and weft of the mesh 104 than the current emulsion 302. (The bottom surface 302'*a* is where the screen inks will be applied and pressed through using the squeegee during the actual screen printing process.) With DtM, because the mesh 104 has the paper backing 112 supported by the smooth platen 114, the underside 302'*a* of the emulsion 302' is more nearly planar or flat. This is also a result of being essentially immediately cured by the UV radiation.

The process is called Direct to Mesh (DtM) to distinguish it from CtS (computer to screen), which requires additional processing both before (i.e., application of the emulsion) and after (washing off the unexposed emulsion and ink). In the DtM process, no additional processing before and after application of the jettable emulsion 302' are needed, thus simplifying the stencil 206 creation.

Figure 4:
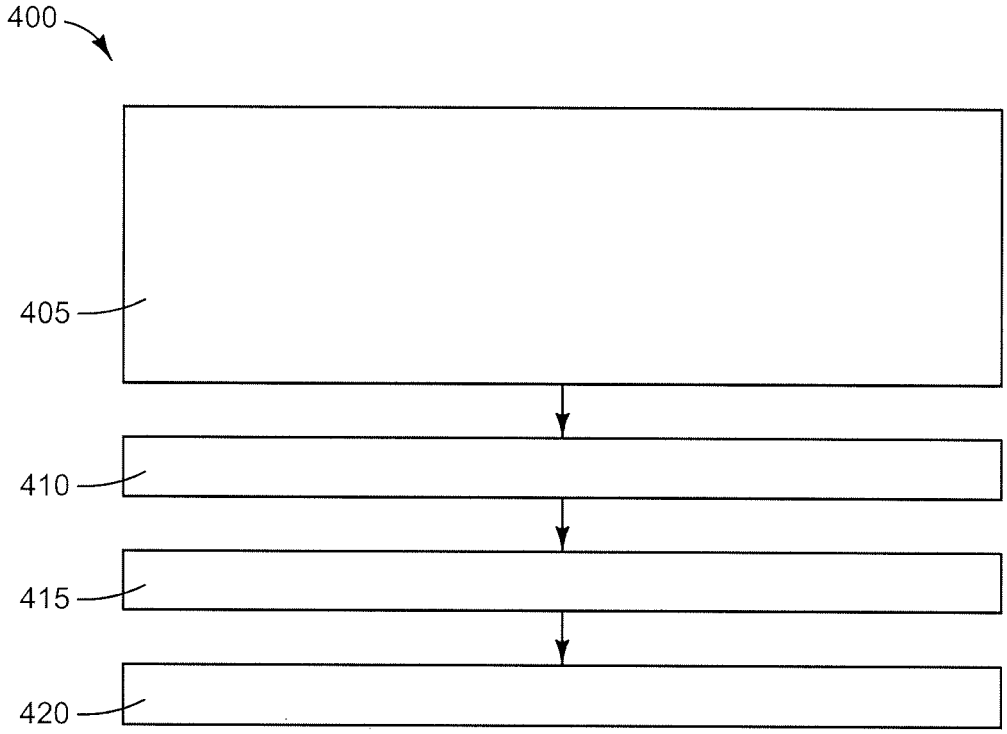
FIG. 4 is a flow chart illustrating a method of screen printing, according to an example of the present disclosure.

FIG. 4 depicts a flow chart of an example DtM process 400, in accordance with the disclosure herein, for preparing a stencil for screen printing. In the process 400, the direct to mesh screen printer 100 is provided 405. As noted above, the DtM screen printer 100 includes the fixture 108 to hold the frame 106, the frame being configured to hold the pre-stretched mesh 104 in place during application of the jettable emulsion 302'. The platen 114 of the DtM screen printer 100 is to hold the release paper 112 against one side of the pre-stretched mesh 104. Finally, the DtM screen printer 100 includes the printer carriage 120 supporting the print head 118 for printing the jettable emulsion 302' on the side of the pre-stretched mesh 104 opposite the platen 114.

The DtM process 400 continues with placing 410 the frame 106 in the fixture 108. The fixture 108 is part of the printer 100 and is adapted to receive a wide variety of frame 106 sizes. The fixture 108 is configured to accurately fix the frame 106 in place, so that the print carriage 120 is accurately registered to the mesh 104.

The DtM process 400 continues with applying 415 the jettable emulsion 302' to the mesh 104. As noted above, the jettable emulsion 302' is applied relative to the mesh 104 by means of the inkjet printer 116, in which the inkjet print head 118 is to jet the jettable emulsion.

The DtM process 400 concludes with curing 420 the jettable emulsion 302' using UV radiation. Any common UV source may be used to cure the jettable emulsion 302'.

At the conclusion of the DtM process 400, the stencil 206 is formed and cured and is ready to be used to screen print colors onto an appropriate print surface, such as clothing, for example.

The major advantages of the DtM process 400 is the complete elimination of both stencil preparation and post-processing as follows:

1. Machines such as emulsion applicators, dryers, separate exposure units are not needed.
2. Most of the chemicals (all except degreasers) and greater than 80% of the water usage are eliminated.
3. All of the processing can be done without having special low UV light rooms. Indeed, the DtM process can be carried out in normal factory/office lighting or daylight. The jettable emulsion is retained inside a UV-protected cartridge or bag when handling. It is only exposed to daylight or UV light when it is jetted onto the mesh 104.
4. Because the process disclosed herein can use conventional, less expensive mesh 104, it can often be more efficient and cheaper to strip and remesh the frame 106 rather than washing the mesh, which entails water and chemicals and a special cleaning station.
5. The raw, unprocessed screen, or mesh, 104 is placed on the printer 100 and a fully prepared, ready to use stencil 206 is removed from the screen that can be placed directly onto a carousel for printing an image onto a print surface.
6. A significant advantage of the DtM process 400 is that each stencil 206 is very accurately registered on the mesh 104 so that it is possible to skip micro-registration when mounting on the carousel. With the DtM process 400, because each stencil 206 is accurately positioned on the frame 106 (both absolute and relative), then no adjustments are necessary or required. This is accomplished through the use of the frame fixture 108. The stencil frame typically has registration holes or point affixed to it. Each different carousel manufacturer has their own registration system. The frame fixture 108 is equipped with the same registration system (or possibly an auxiliary registration system of another design). The frame fixture 108 permits the precise alignment of the stencil frame 106. To accomplish this, a test print is done with the 4 (or 6 or more) colors, then the carousel is fine-tuned. As long as no changes to the carousel are made (or the carousel does not get out of alignment) and all stencils are created on the same printer, then the stencils will be precisely aligned.

It will be appreciated that the DtM process 400 disclosed herein has significant reductions in either or both process time and complexity, labor, and capital equipment (including specialized lighting facilities), as well as significant reductions of process chemicals and water.

The DtM process 400 can also be used for rotary screen printing. Rotary screen printing is used in labelling and other somewhat narrow but frequently repeated printing processes (wall papers, linear linoleum, etc.). Rotary screen printing is extremely fast for these applications, where each of the four colors (and any spot colors) are placed on cylinders and the material passes underneath. Rotary screen printing typically uses stainless steel mesh 104 for durability and stability.

Today, many rotary stencils are made by large service bureaus (there are about three in Europe). Each stencil can cost over 100 €uros and the yearly cost of stencil replacement can run several hundred thousand €uros. This does not even take into account the inconvenience of using the service bureau. Many companies would be able to recoup the cost of a machine in a couple of quarters while reducing their dependence on expensive service bureaus.

It is appreciated that, in the foregoing description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

While a limited number of examples have been disclosed, it should be understood that there are numerous modifications and variations therefrom. Similar or equal elements in the Figures may be indicated using the same numeral.

It is be noted that, as used in this specification and the appended claims, the singular forms "a," "an," and "the" include plural referents unless the context clearly dictates otherwise. It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other. Furthermore, when "about" is utilized to describe a value, this is meant to encompass minor variations (up to ±10%) from the stated value, such as might be induced by variations in manufacturing.

While a limited number of examples have been disclosed, it should be understood that there are numerous modifications and variations therefrom. For example, the "orientation" of the printer bed/table may be changed from horizontal to vertical, due to new high/ultra-high velocity print head technologies that may permit jetting onto a vertical surface.

What is claimed is:

1. A direct to mesh screen printer for creating a screen stencil, including:

a frame for holding a pre-stretched mesh in place during application of a jettable emulsion;

a fixture to hold the frame;

a platen to hold a release paper against one side of the pre-stretched mesh; and a printer carriage supporting a print head for printing the jettable emulsion on a side of the pre-stretched mesh opposite the platen, wherein the release paper inhibits dot-gain of the jettable emulsion when the jettable emulsion is printed on the pre-stretched mesh and does not adhere to a cured emulsion formed from the jettable emulsion printed on the pre-stretched mesh.

2. The direct to mesh screen printer of claim 1, wherein the fixture is configured to securely and firmly hold the frame with the pre-stretched mesh in place during the application of the jettable emulsion.

3. The direct to mesh screen printer of claim 1, wherein the platen is configured to hold the release paper firmly against the bottom of the pre-stretched mesh.

4. The direct to mesh screen printer of claim 3, wherein the platen is smooth and resistant to dents and cracks.

5. The direct to mesh screen printer of claim 1, wherein the release paper is lightly attached to the platen to prevent movement during the application of the jettable emulsion.

6. The direct to mesh screen printer of claim 1, wherein the printer carriage is accurate in both the X and Y Cartesian directions to support accurate droplet placement over multiple passes while building up the emulsion on the mesh.

7. The direct to mesh screen printer of claim 1, wherein the jettable emulsion has a low viscosity of about 4 cP to about 15 cP and is both durable and flexible/elastic.

8. The direct to mesh screen printer of claim 7, wherein the jettable emulsion is a UV-activated acrylate monomer with elastomeric qualities after curing.

9. The direct to mesh screen printer of claim 1, further including a UV source for curing the jettable emulsion and forming a stencil for screen printing.

10. A process, including:

providing a direct to mesh screen printer, including a fixture to hold a frame, which is configured to hold a pre-stretched mesh in place during application of a jettable emulsion, a platen to hold a release paper against one side of the pre-stretched mesh, and a printer carriage supporting a print head for printing the jettable emulsion on a side of the pre-stretched mesh opposite the platen;

placing the frame in the fixture;

applying the jettable emulsion to the mesh; and curing the jettable emulsion using UV radiation to obtain a cured emulsion with a flat surface located against the release paper, wherein the release paper inhibits dot-gain while applying the jettable emulsion to the mesh and does not adhere to the cured emulsion.

11. The process of claim 10, wherein following placing the frame in the fixture, the platen with release paper is moved in the direction of the mesh so that the release paper contacts the mesh.

12. The process of claim 10, wherein the cured emulsion forms a screen stencil, in which openings in the stencil are to be used to form an image on a surface.

13. The process of claim 10, wherein the jettable emulsion is a UV-activated acrylate monomer with elastomeric qualities after curing.

* * * * *